US007775763B1

(12) United States Patent
Johnson et al.

(10) Patent No.: US 7,775,763 B1
(45) Date of Patent: Aug. 17, 2010

(54) CENTRIFUGAL PUMP WITH ROTOR THRUST BALANCING SEAL

(75) Inventors: Gabriel L. Johnson, Port St. Lucie, FL (US); Alex Pinera, Jupiter, FL (US); Ross H. Peterson, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 684 days.

(21) Appl. No.: 11/821,137

(22) Filed: Jun. 21, 2007

(51) Int. Cl.
*F04D 1/00* (2006.01)

(52) U.S. Cl. ..... 415/111; 415/174.1; 415/224.5

(58) Field of Classification Search ..... 415/111, 415/171.1, 174.4, 224.5
See application file for complete search history.

(56) References Cited

U.S. PATENT DOCUMENTS

| | | | | |
|---|---|---|---|---|
| 1,020,699 | A | 3/1912 | Kieser | |
| 1,488,931 | A | 4/1924 | Marechal | |
| 1,651,855 | A | 12/1927 | Warren | |
| 1,857,961 | A | 5/1932 | Lamb | |
| 2,058,993 | A | 10/1936 | Keller | |
| 3,642,379 | A * | 2/1972 | Swearingen | 415/119 |
| 3,664,758 | A | 5/1972 | Sato | |
| 4,493,610 | A | 1/1985 | Iino et al. | |
| 4,820,115 | A | 4/1989 | Bandukwalla | |
| 4,867,633 | A | 9/1989 | Gravelle | |
| 5,385,442 | A | 1/1995 | Lehe et al. | |
| 6,129,507 | A | 10/2000 | Ganelin | |
| 6,935,838 | B1 * | 8/2005 | Wang | 415/199.1 |

* cited by examiner

*Primary Examiner*—Igor Kershteyn
(74) *Attorney, Agent, or Firm*—John Ryznic

(57) ABSTRACT

A centrifugal pump or compressor with a labyrinth seal that produces an axial thrust balance when the impeller shifts in the axial direction due to fluid pressure forces acting on the impeller, and a process for reducing the axial thrust imbalance by regulating the fluid leakage from a front pressure cavity of the pump. The impeller includes a front face that forms part of a front pressure cavity in which fluid pressure acts that produces a thrust imbalance on the impeller. A labyrinth seal with a plurality of teeth is formed between the housing and the front face of the impeller near the impeller inlet. The teeth form gaps with lands formed on the impeller face, where the lands are slanted and stepped such that axial displacement of the impeller changes the gap space to regulate the fluid pressure acting in the front cavity. A self regulating fluid pressure is developed within the front cavity to produce a balancing force against the impeller.

11 Claims, 6 Drawing Sheets

CENTRIFUGAL PUMP WITH ROTOR THRUST BALANCING SEAL

BACKGROUND OF THE INVENTION

1. Field of the Invention

The present invention relates generally to a centrifugal pump, and more specifically to a rotor thrust balance of the centrifugal pump.

2. Description of the Related Art Including Information Disclosed Under 37 CFR 1.97 and 1.98

Rotary machines such as a centrifugal pump are used to pressurize a fluid such as a liquid or a gas. In a centrifugal pump, the fluid flows axially into the inlet of the pump and radially outward at the exit. The outlet also has a tangential component of velocity due to the rotation of the radial directed outlet. A typical single stage or multiple staged rotary pump or compressor contains a rotor surrounded by a stationary shroud or housing. An active part of the rotor is sometimes referred to as an impeller which typically contains an arrangement of vanes, disks or other components forming a pumping element that transforms its kinetic rotational energy to the pumping fluid.

In a rotary machine, such as a centrifugal compressor or pump, the presence of an axial force which is also known as an axial thrust is produced on the rotor disk. The axial thrust can impact the performance of the rotor. Depending on the rotational speed, the rotor diameter, fluid dynamics, annular gap leakage flows and other parameters, the axial thrust produced may reach such significant levels and as such present a challenge to the longevity and reliability of the rotary machine operation. Axial load is especially harmful for the axial thrust bearings. Failure of the axial thrust bearing can cause general failure of the rotary machine. Expensive procedures of bearing replacement comprises a significant part of the overall maintenance of the rotary machine, especially for a turbojet engine and similar machines in which access to the axial bearings is quite difficult.

It is also known in the art of rotary machines that the level of axial thrust forces depends on the wear state of the rotor seals of the machine. As the seals wear out, the annular gap leakage flow increases which changes unfavorably the hydrodynamic nature of the vortex flows in the cavities between the rotor and the housing of the rotary machine and typically causes the increase in the axial thrust. That in turn causes higher loads on the axial thrust bearings and may bring about their premature failure.

The challenge of reducing the axial thrust has been long recognized by the designers of the rotary machines. A variety of concepts has been proposed in the prior art in attempt to solve this problem. One of the most popular methods of reducing the axial thrust is the use of a balancing disk or drum. A balancing drum or disk is added in the back of the rotor and placed in its own balancing cavity in such a way that one side of the disk is subjected to high fluid pressure in order to compensate for the axial thrust cumulatively developed in all the prior stages of the machine. Examples of various designs of such balancing disks can be found in U.S. Pat. No. 5,591,016 by Kubota; U.S. Pat. No. 5,102,295 by Pope; U.S. Pat. No. 4,892,459 by Guelich; as well as U.S. Pat. Nos. 4,538,960 and 4,493,610 by Iino. Although capable of reducing the axial thrust to a certain extent, these devices are not generally capable of eliminating the problem over a wide range of rotor speeds and pumping conditions. In addition, they are not as simple to implement, require their own maintenance service and increase the size, inertia and weight of the rotary machine which ultimately reduces its efficiency of operation. They also increase the annular gap leakage and in addition can not compensate for the increasing axial thrust due to the wear of the rotary machine seals.

Another method of axial thrust compensation is to increase the fluid pressure in the appropriate cavity of the rotary machine to exert higher pressure on the rotor and therefore to compensate for the axial thrust. Various additional fluid passages have been proposed in the rotary machines of the prior art for the purposes of creating conditions of changing the fluid pressure against the certain areas of the rotor. Examples of single- and multi-staged rotary machines utilizing these devices are described in U.S. Pat. No. 5,862,666 by Liu; U.S. Pat. No. 5,358,378 by Holscher; U.S. Pat. No. 5,104,284 by Hustak; and U.S. Pat. No. 4,170,435 by Swearingen. Rotary machines of this type employ complicated monitoring and control devices designed to adjust the leakage rates and the pressure values of the additional fluid passages in order to compensate for the axial thrust over a wide range of operating parameters. In addition to complexity, another limitation of this approach is the hydraulic losses associated with these compensating fluid passages which negatively affect the hydraulic and overall efficiency of the rotary machine. As with balancing disks, these devices require separate maintenance and thus increase the operation costs of the machine.

One of the simplest and quite efficient ways to address the problem of the axial thrust is the use of so called swirl brakes described for example in the U.S. Pat. No. 5,320,482 by Palmer or in the article by J. M. Sivo entitled "The influence of swirl brakes on the rotor dynamic forces generated by discharge-to-suction leakage flows in centrifugal pumps" (Transactions of ASME, Volume 117, March 1995, pages 104-108). A plurality of stationary ribs, grooves, cavities or vanes located along the housing of the rotary machine are utilized to change favorably the fluid pressure distribution outside the rotor in order to reduce the axial thrust. Although simple and reliable, this method has its own limitations such as creating additional localized vortexes and areas of hydraulic disturbances in the rotary machine which reduces its hydraulic efficiency.

Another method of axial thrust reduction is proposed in the U.S. Pat. No. 4,867,633 by Gravelle. Hydraulic thrust balance is achieved and continuously maintained according to that patent by the controlled axial movement of the rotor shaft and the rotor in order to modulate the gap at the rear seal and therefore control the pressure acting on the back side of the rotor. In that case, an outward thrust force resulting from the rotor operation counterbalances an inward thrust force resulting from the pressure acting on the front side of the rotor. This device is quite complicated and delicate and requires careful adjustment for proper operation. It also reduces the hydraulic efficiency of the machine.

The centrifugal pump in the U.S. Pat. No. 1,020,699 issued to Kieser on Mar. 19, 1912 shows a discharge portion of the pump with parallel outer walls lying in planes perpendicular to the axis. The hub has a series of steps formed by perpendicular and circumferential surfaces. A narrow clearance space is formed between the adjacent surfaces formed between the stationary pedestal and the rotating stepped surfaces. FIG. 6 shows the arrangement of the Kieser stepped seal. When the impeller shifts in the axial direction, the clearance between the surfaces will remain unchanged while those on one side of the impeller and between the surfaces perpendicular to the axis will decrease and those on the opposite side increase. As a result of this axial shift, pressure will build up on one side of the rotor and balance the axial force. However, in this prior art rotor thrust balancing seal, the gap clearance remains the same as the rotor shifts axially and therefore the pressure on that side of the rotor will not vary.

Another prior art centrifugal pump rotor thrust balancing arrangement is disclosed in U.S. Pat. No. 6,129,507 issued to Ganelin on Oct. 10, 2000 which discloses a method and device for reducing or eliminating axial thrust in a rotary machine such as a centrifugal pump or compressor by altering the fluid pressure in a cavity formed between a rotor and a housing. The Ganelin patent is incorporated herein by reference. The device contains a disk placed along the rotor for subdividing the fluid in the cavity in such a way that all annular gap leakage flow is channeled and pumped through the space between that disk and the rotor from the center of the pump towards the periphery. As a result, the pressure in the cavity is altered to reduce and control the axial thrust on the rotor which becomes independent of the wear state of the shaft seals. In another embodiment, the step of flow subdividing is achieved by providing a set of braking vanes along the periphery of the cavity for reducing the rotational speed of the fluid coming from the cavity as well as from the annular gap and a stationary disk placed along the interior wall of the housing for directing the radial flow of that fluid towards the center of the pump.

U.S. Pat. No. 5,385,442 issued to Lehe et al on Jan. 31, 1995 discloses a centrifugal pump with an open-faced impeller in which the balancing chamber communicating with the delivery pipe via a first nozzle whose axial clearance is kept invariable in operation and which is defined by the peripheral end of the impeller itself acting as a balancing turntable, and a nozzle piece secured to the outer rear portion of the casing and interposed between the diffuser and said peripheral end of the impeller. The balancing chamber communicating directly or indirectly with the suction pipe of the pump via a second nozzle. FIG. 7 shows impeller tip seal used in the Lehe et al patent.

The need exists therefore for a device to reduce axial thrust that is simple in design, is easy to install in existing rotary machines, does not require monitoring and control devices in order to work properly, and is effective in its function over a wide range of operating parameters of the rotary machine.

The need also exists for a device to reduce and control axial thrust that would allow reducing or preferably eliminating completely the dependency of the axial thrust forces on the wear state of the seals in a rotary machine.

BRIEF SUMMARY OF THE INVENTION

A centrifugal pump having a hub with an axial inlet and a radial outlet for discharging the fluid being pumped. The pump housing forms a front shroud cavity and a rear hub or blackface cavity in which pumped fluid leaks into and, due to the pressure of the fluid, produces an axial force against the hub. On the inlet side of the centrifugal pump is a labyrinth seal with angled lands that form a leakage gap or space for this seal. The tip surfaces of each tooth and the angled lands have substantially the same inclination such that axial displacement of the teeth with respect to the lands produce an increase in the gap or space formed in the labyrinth seal. As the discharge pressure of the pump increases, the fluid pressure acting in the shroud cavity will increase and therefore produce a higher axial force to increase the labyrinth seal gap. The increased labyrinth seal gap will allow for a greater leakage of the fluid from the shroud cavity and therefore a decrease in the fluid pressure acting to force the hub axially. The angled teeth tips and lands thus produce a self regulating feature to control the fluid pressure in the shroud cavity that displaces the hub in the axial direction. The hub is self balancing and balances the thrust to reduce the load on the bearings. A similar labyrinth seal can be located on the back side of the hub for the hub cavity with the gap varying due to axial displacement of the impeller disk.

DETAILED DESCRIPTION OF THE INVENTION

The present invention is a centrifugal pump with an impeller or hub supported for rotation by bearings in which a multiple tooth labyrinth seal is arranged such that axial movement of the hub due to pressure variations will change the gap in the labyrinth seal to vary the pressure acting on one side of the hub to provide a thrust balance. The rotor thrust balancing apparatus and method of the present invention can be used in a centrifugal pump or a compressor such as a turbo compressor. A pump is typically used to describe an apparatus that increases the pressure of a liquid while a compressor increases the pressure of a compressible gas. For the purposes of this present invention, a compressor and a pump are used interchangeable to describe a rotary apparatus that increases the pressure of a liquid or a gas.

Figure 1:
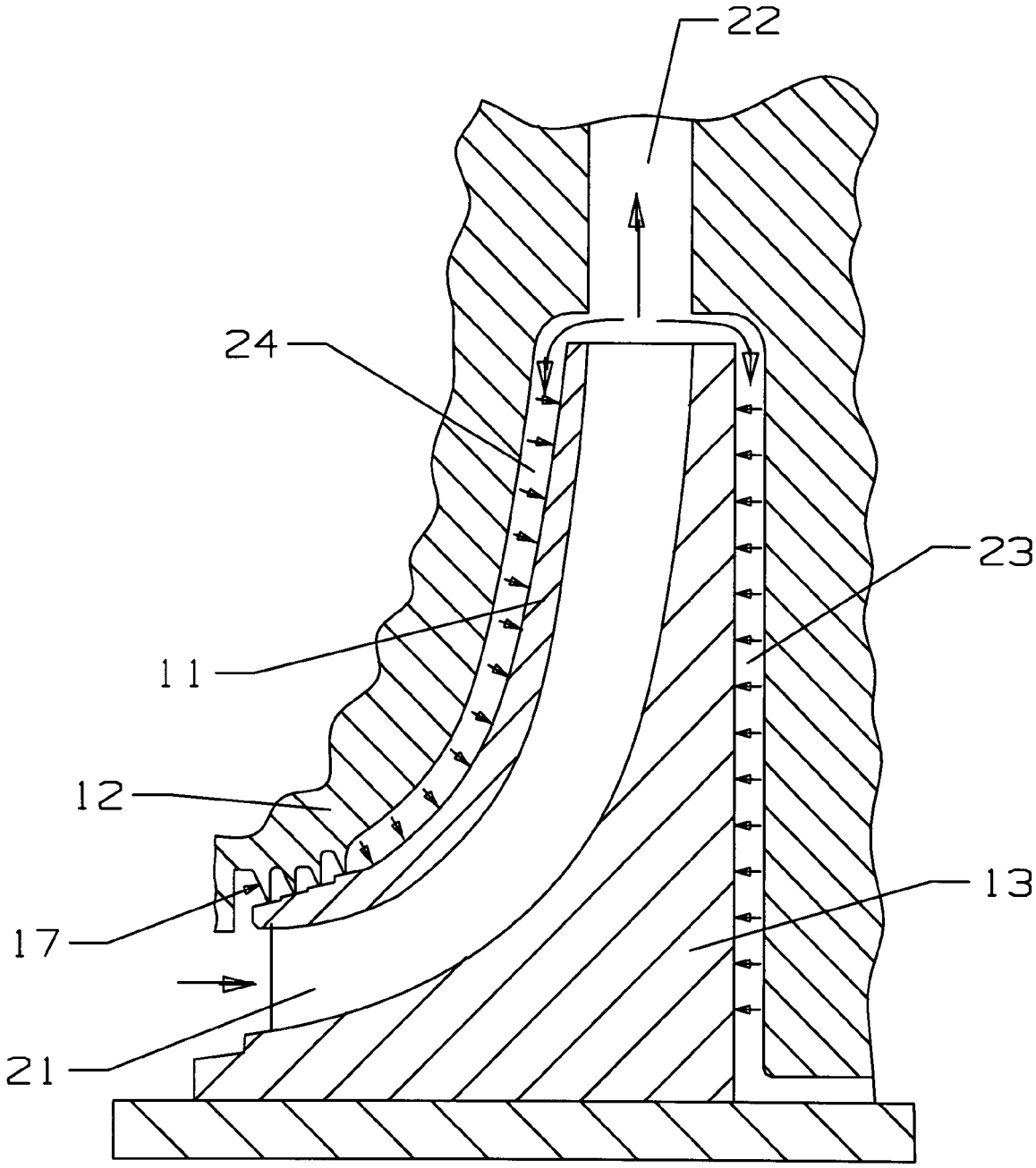
FIG. 1 shows a cross section of the centrifugal pump and angled labyrinth seal used in the present invention.

FIG. 1 shows a cross section view of the centrifugal pump with an hub 13 rotatably secured within pump housing or casing 12 in which the rotating hub 13 is supported by front and rear bearings (not shown). The hub 13 includes blades that form closed fluid passages between a rear disk of the hub 13 and a shroud 11. The blades and the shroud 11 form an axial fluid inlet 21 and a radial fluid outlet 22 for the hub with the closed fluid path between the inlet and the outlet. A rear or hub cavity 23 and a front or shroud cavity 24 are formed between the hub 13 and the housing 12. Pressurized fluid from the outlet 22 of the hub will leak into both the shroud cavity 24 and the hub cavity 23 and produce a net force against the hub 13 that tends to shift the hub 13 in an axial direction. This axial shift or axial directed force due to the pressure difference acting on the hub 13 will produce high loads on the bearings which is undesired.

The fluid pressure in the hub cavity 23 acting against the rear disk of the hub 13 is a function of the outlet 22 pressure of the impeller. As the outlet 22 pressure increases, the fluid pressure acting in the hub cavity 23 will produce a greater axial force on the hub in the direction of the inlet 21. The main feature of the present invention is the labyrinth seal with a varying gap to vary the leakage flow from the shroud cavity 24 and control the pressure force on the hub 13 acting against the hub cavity force.

Figure 2:
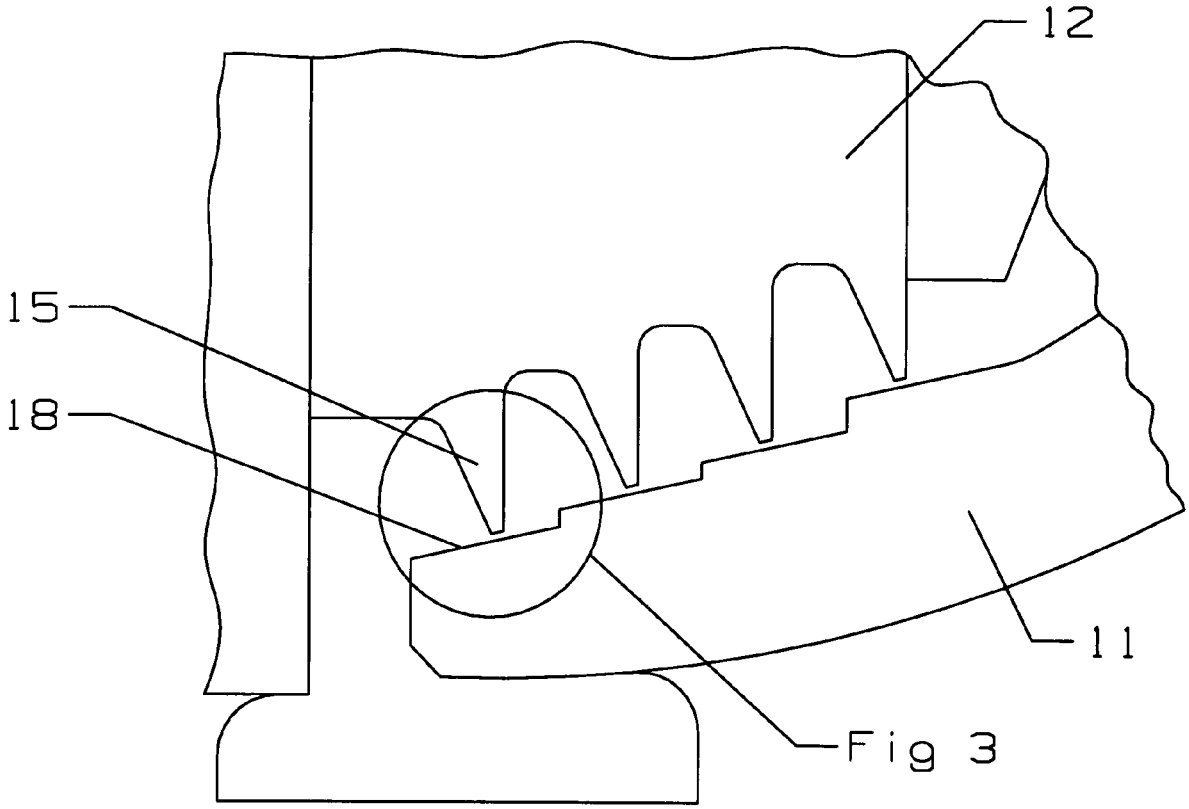
FIG. 2 shows a detailed view of the angled labyrinth seal of the present invention in FIG. 1.
Figure 3:
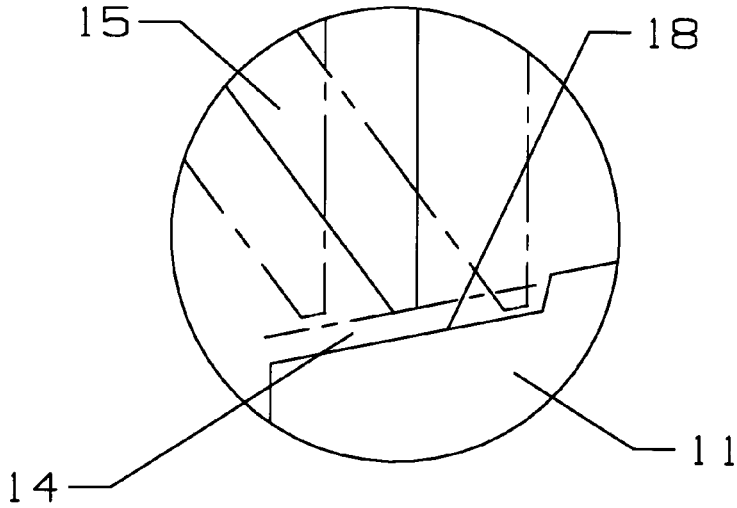
FIG. 3 shows the variable gap spacing between the teeth and the angled lands of the seal used in the present invention as the hub shifts in the axial direction.

FIG. 2 shows a detailed view of the inlet labyrinth seal 17 of the present invention. The inlet labyrinth seal is located on the inlet end of the hub 13 and provides for a seal between the rotating hub 13 and the stationary housing 12. The stationary housing 12 includes a plurality of teeth 15 extending toward lands 18 formed on the front face of the hub 13 that form a gap or space 14 for fluid leakage. The teeth 15 have tips with a slanted surface that is substantially parallel to the lands 18. FIG. 3 shows a detailed view of the gap 14 between the teeth 15 tip and the land 18. The lands 18 are slanted in order to allow for the gap 14 to vary as the land 18 moves axially. As seen in the FIG. 9 embodiment, the lab seal could have the fingers 15 extending from the shroud 11 and the lands formed on the stationary housing 12.

Figure 4:
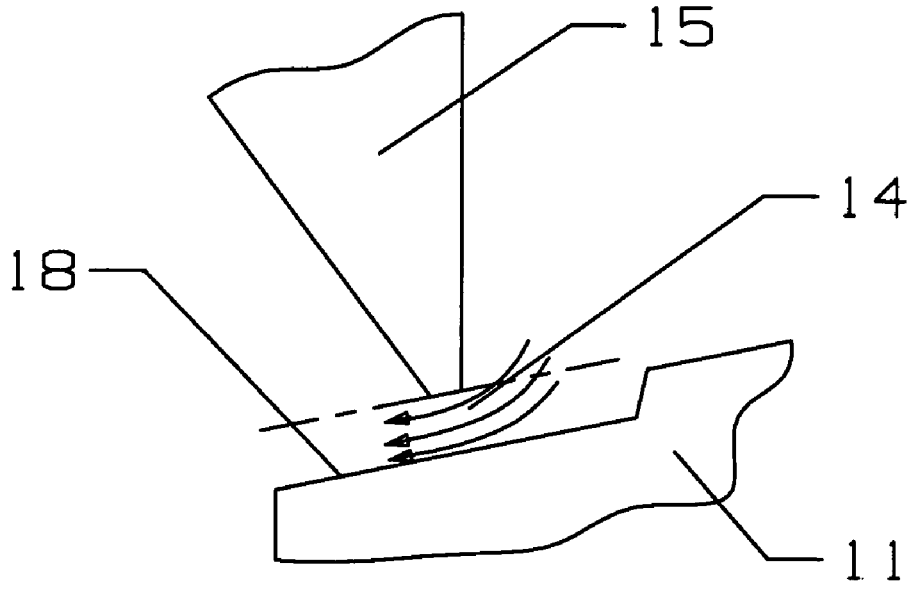
FIG. 4 shows the leakage flow paths in the constant diameter gap in the labyrinth seal of the present invention.
Figure 5:
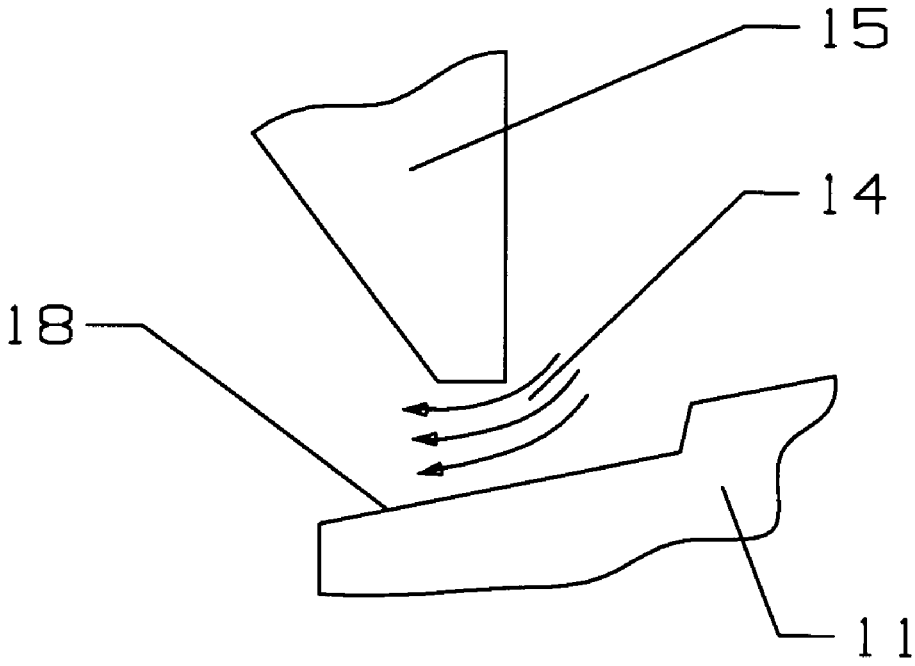
FIG. 5 shows the leakage flow paths in a labyrinth seal with the gap forming a diffuser between the teeth and the lands.
Figure 6:
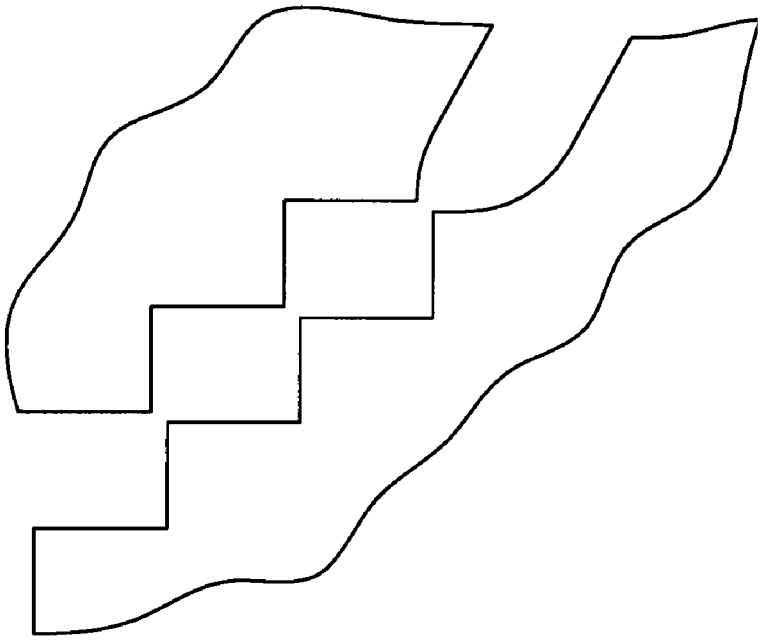
Fig 6 Prior Art
FIG. 6 shows a prior art step seal with no lands used in the prior art centrifugal pump seals.
Figure 7:
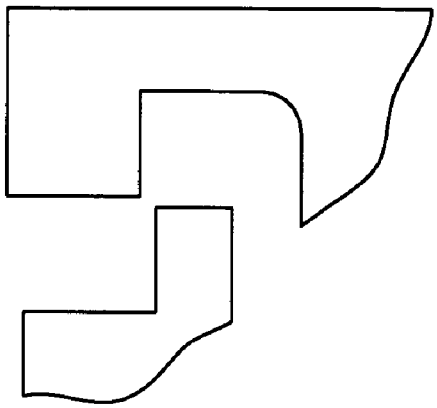
Fig 7 Prior Art
FIG. 7 shows a prior art corner seal used in a centrifugal pump.

FIG. 4 shows the gap 14 formed between the tooth 13 tip and the land 18 of one embodiment of the present invention. In the FIG. 4 embodiment, the passage formed between the tooth 15 tip and the land 14 is constant because the tooth 15 tip surface is parallel to the land 18 surface. In the FIG. 5 embodiment, the gap increases between the tooth 15 tip and the land 18 because the tooth 15 tip surface is not parallel to the land 18 surface. This functions to produce diffusion in the leakage flow across the gap 14. The FIG. 4 embodiment has a discharge coefficient larger than the embodiment in FIG. 5. A higher discharge coefficient will produce a higher leakage flow across the gap 14. This can be used to control the gap 14 flow leakage and thus the pressure acting in the shroud cavity 24 for the thrust balancing capability of the present invention which will be described below.

The operation of the labyrinth seal with varying gap and thrust balancing capability of the present invention will now be described. As the hub rotates, fluid is pumped from the inlet 21 in an axial direction and discharge from the outlet 22 in the radial direction. The pressure of the fluid at the outlet 22 is higher than in the inlet 21. Fluid pressure from the outlet 22 also acts within the rear hub cavity 23 and the front shroud cavity 24 to produce an axial net force on the hub. The pressure force acting in the rear hub cavity 23 is a function of the outlet pressure of the hub 13. Because the surface area of the rear hub cavity 23 is larger than the front shroud cavity 24, as the fluid pressure increases the resulting force acting against the hub 13 will tend to be greater in the axial direction toward the inlet 21 end. With a greater axial force tending to force the hub 13 toward the inlet 21 end, the lands 18 will be displaced in the left direction of FIG. 3 and shorten the gaps 14. With a shorter gap 14 formed in the front or inlet labyrinth seal 17, the leakage flow will decrease and the resulting pressure acting in the front shroud cavity 24 will increase. Thus, a greater force is created in the front shroud cavity 24 that will tend to balance the pressure force acting in the rear hub cavity 23.

In an opposite sense, when the pressure acting in the front shroud cavity 24 increases, a greater pressure force will act against the front face of the hub 13 and force the hub 13 in the axial direction away from the inlet 21 end. As the hub 13 shifts away from the inlet 21 end, the gaps 14 in the inlet labyrinth seal 17 will increase and thus the leakage across the inlet labyrinth seal 17 will increase. With increasing leakage flow, the pressure acting in the front shroud cavity 24 will decrease while the pressure acting in the rear hub cavity 23 remains constant. The net force acting on the hub 13 will tend to shift the hub 13 away from the inlet 21 end and therefore provide a thrust balancing effect to the hub.

The inlet labyrinth seal 17 gap size and shape can be regulated to control the pressure within the front shroud cavity 24 based upon the pump outlet pressure and the axial displacement of the hub lands 18. Thus, a thrust balance can be effectively controlled to prevent excessive loads acting on the bearing due to thrust imbalance. Because the bearing tends to wear prematurely when excessive loads are applied, the centrifugal pump with the thrust balancing capability of the present invention will have a longer life.

Figure 8:
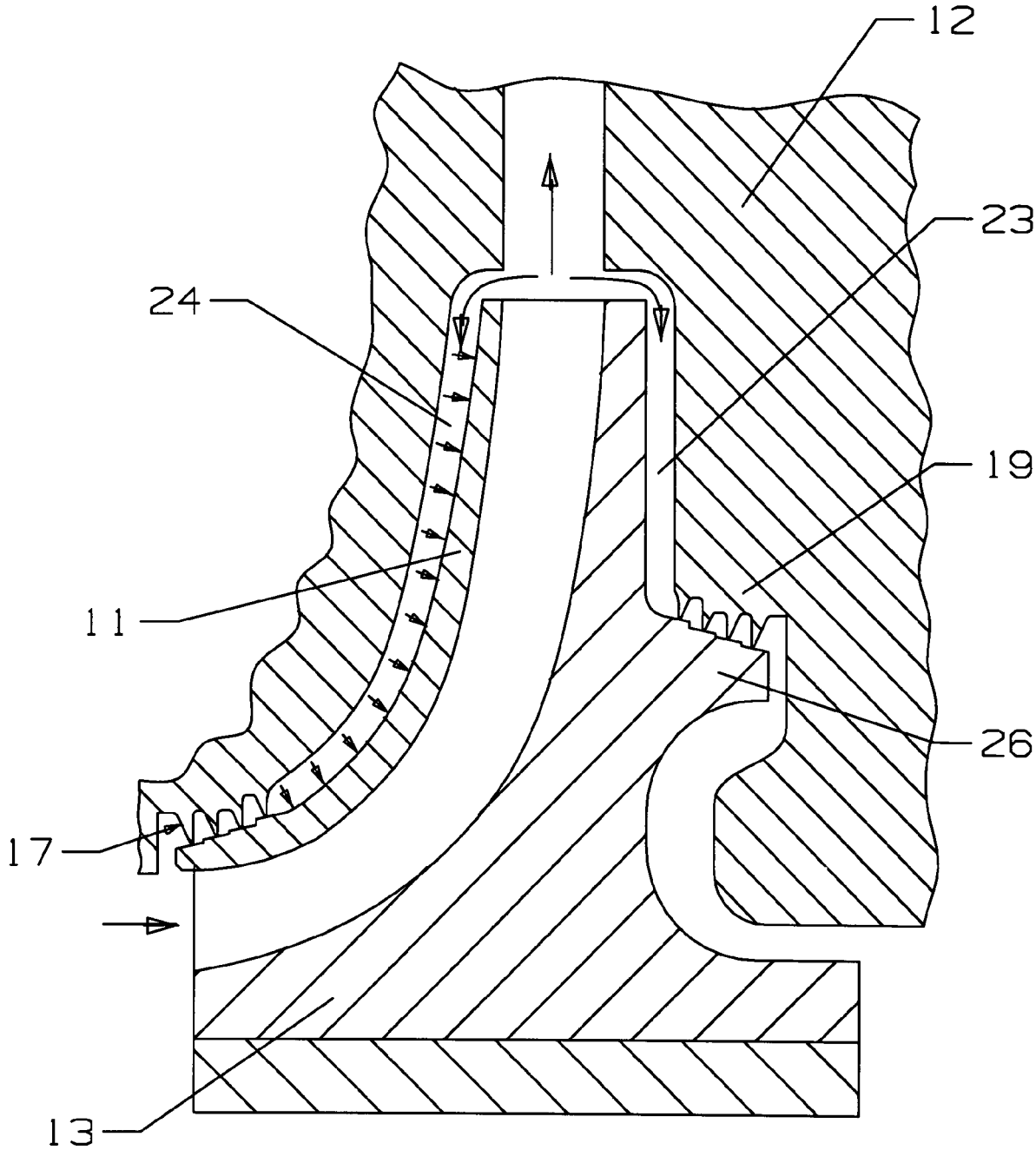
FIG. 8 shows an additional embodiment of the present invention in which the back side of the hub includes a labyrinth seal with the gap varying with axial displacement of the hub.

An additional embodiment of the present invention is shown in FIG. 8, and includes a rear or outlet labyrinth seal 19 formed between the housing 12 and a rear land extension 26 formed as part of the hub 13. The rear labyrinth seal 19 has similar structure and function as the front labyrinth seal 17 in which the teeth have tip surfaces that are parallel to the land surfaces on the rear land extension 26 so that the gap 14 between the teeth and the lands will change with axial displacement of the hub 13 as in the front lab seal 17. However, as the gaps in the front lab seal 17 decreases, the gaps in the rear lab seal 19 will increase. The gaps in the rear lab seal 19 can have constant diameter as in FIG. 4 or varying diameter as in FIG. 5 to produce a diffusion effect in the leakage flow.

The FIG. 8 embodiment operates by decreasing the fluid pressure in the cavity by increasing the flow leakage through the gaps in the lab seal as the hub is displaced axially due to the net pressure force acting on the hub. If the fluid pressure in the front cavity 24 produces a net force on the hub 13 to move the hub toward the hub cavity 23, then the gap in the front lab seal 17 will increase while the gap in the rear lab seal 19 will decrease. The fluid pressure in the front shroud cavity will decrease while the fluid pressure in the rear hub cavity will increase. The resulting net force will thus be balanced. As the pump outlet pressure changes, the resulting pressures acting in the shroud and hub cavities will displace the hub axially until the hub is balanced under the new pump outlet pressure.

Figure 9:
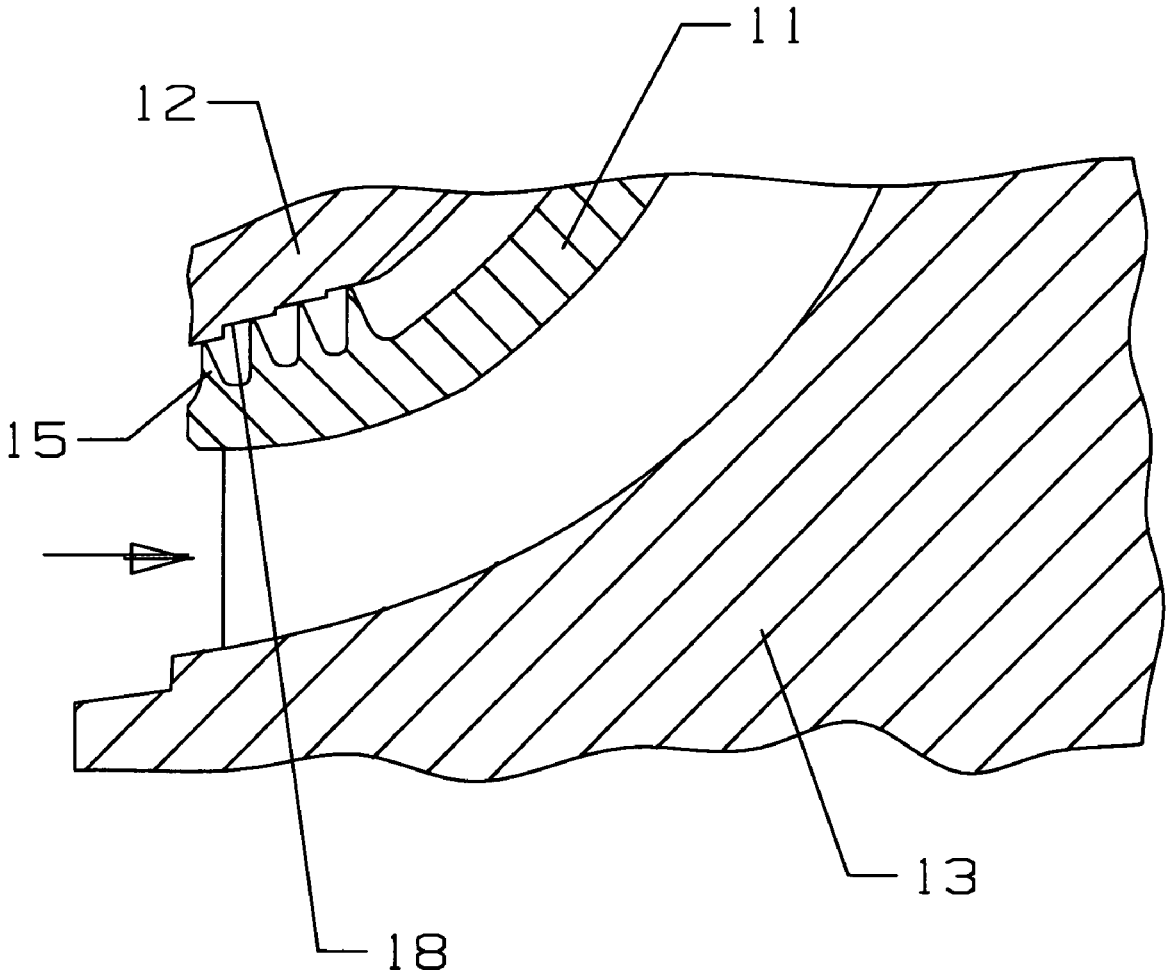
FIG. 9 shows another embodiment of the present invention in which the teeth of the labyrinth seal are located on the rotating shroud and the lands are on the stationary housing.

FIG. 9 shows the front or inlet lab seal 17 in which the teeth and the lands are reversed from the first embodiment of FIGS. 1-3. In FIG. 9, the teeth 15 of the lab seal extend from the rotating shroud 11 while the lands 18 are formed on the stationary housing 12. in the FIG. 9 embodiment, the lands 18 are slanted as in the FIG. 3 embodiment, while the tip surfaces of the teeth 15 can be parallel to the land surface 18 as in the FIG. 4 embodiment, or diverge outward in the leakage flow direction to produce a diffusion effect in the flow leakage as discussed in the FIG. 5 embodiment. The FIG. 8 embodiment of the pump with lab seals on both sides of the hub 13 can have the tooth tip surfaces with the parallel (FIG. 4) or slanted surfaces (FIG. 5) for producing the diffusion effect.

Thus, the present invention provides for a centrifugal compressor or pump with an axial inlet and a radial outlet in which one or both sides of the hub includes a cavity with a labyrinth seal having teeth with tip surfaces parallel to or slanted to land surfaces in order to more precisely control the leakage across the one or more labyrinth seals for purpose of accurately balancing the thrust load produced on the hub by the outlet pressure. The multiple tooth labyrinth seals used in the present invention provide for less leakage across the seals than would the prior art Gravelle U.S. Pat. No. 4,867,633 that uses the step seals. Labyrinth seals are more precise than stepped seals. Also, more historical data is available for labyrinth seals, and therefore the results of the leakage can be more accurately predicted during the design process. Also, labyrinth seals can be used for a larger range of fluids with various densities and compressibility. When designing for a thrust balancing hub for a centrifugal compressor or pump, this precision in design will result in less leakage in the compressor or pump with the more control in the balancing of thrust across the hub. Therefore, a more efficient compressor or pump with thrust balance is provided with the use of the disclosed present invention.

We claim:

1. A centrifugal pump or compressor comprising:

a hub having an axial inlet and a radial outlet, the hub being rotatably supported within a housing;

a shroud integral to the hub and forming a fluid path between the axial inlet and the radial outlet;

a shroud cavity formed between the housing and the shroud of the hub;

a hub cavity formed between the housing and the hub; and, at least one labyrinth seal formed between the housing and the hub to allow for fluid leakage from the hub cavity, the labyrinth seal having teeth that extend substantially in a radial direction of the pump or compressor and a gap that changes with an axial displacement of the hub, the fluid leakage across the labyrinth seal being a function of an axial displacement of the hub such that a thrust balance on the hub is produced.

2. The centrifugal pump or compressor of claim 1, and further comprising:

the labyrinth seal is located on the inlet end of the pump and formed between the shroud and the housing.

3. A centrifugal pump or compressor comprising:

a hub having an axial inlet and a radial outlet, the hub being rotatably supported within a housing;

a shroud integral to the hub and forming a fluid path between the axial inlet and the radial outlet;

a shroud cavity formed between the housing and the shroud of the hub;

a hub cavity formed between the housing and the hub;

at least one labyrinth seal formed between the housing and the hub to allow for fluid leakage from the cavity, the fluid leakage across the labyrinth seal being a function of an axial displacement of the hub such that a thrust balance on the hub is produced; and, the labyrinth seal comprises a plurality of teeth with tips having a flat surface and a plurality of land having a slanted surface, the tip surface and the land surface forming a gap for fluid leakage across the labyrinth seal.

4. The centrifugal pump or compressor of claim 3, and further comprising:

the slanted surface of the lands slant away from the hub in a direction of the fluid leakage across the labyrinth seal.

5. The centrifugal pump or compressor of claim 4, and further comprising:

the slanted lands are also stepped lands.

6. The centrifugal pump or compressor of claim 3, and further comprising:

the teeth of the labyrinth seal extend from the housing, and the lands are formed on the rotating shroud of the hub.

7. The centrifugal pump or compressor of claim 3, and further comprising:

the lands of the labyrinth seal extend from the housing, and the teeth are formed on the rotating shroud of the hub.

8. The centrifugal pump or compressor of claim 3, and further comprising:

the flat surfaces of the teeth tips are parallel to the land surfaces such that the flow space is substantially constant.

9. The centrifugal pump or compressor of claim 3, and further comprising:

the flat surfaces of the teeth tips are slanted in the leakage downstream direction with respect to the land surfaces such that a diffuser is formed in the flow space.

10. The centrifugal pump or compressor of claim 3, and further comprising:

the labyrinth seal consists of four teeth and four lands.

11. A centrifugal pump or compressor comprising:

a hub having an axial inlet and a radial outlet, the hub being rotatably supported within a housing;

a shroud integral to the hub and forming a fluid path between the axial inlet and the radial outlet;

a shroud cavity formed between the housing and the shroud of the hub;

a hub cavity formed between the housing and the hub;

at least one labyrinth seal formed between the housing and the hub to allow for fluid leakage from the cavity, the fluid leakage across the labyrinth seal being a function of an axial displacement of the hub such that a thrust balance on the hub is produced;

the first labyrinth seal is located on the inlet end of the pump or compressor and is in fluid communication with the shroud cavity;

a second labyrinth seal formed between the housing and the hub on the aft end of the pump or compressor and in fluid communication with the hub cavity; and, the fluid leakage across the second labyrinth seal increases while the fluid leakage across the first labyrinth seal decreases with an axial displacement of the hub in the aft direction while the fluid leakage across the second labyrinth seal decreases while the fluid leakage across the first labyrinth seal increases with an axial displacement of the hub in the inlet direction.

* * * * *

UNITED STATES PATENT AND TRADEMARK OFFICE

CERTIFICATE OF CORRECTION

PATENT NO. : 7,775,763 B1
APPLICATION NO. : 11/821137
DATED : August 17, 2010
INVENTOR(S) : Gabriel L. Johnson et al.

It is certified that error appears in the above-identified patent and that said Letters Patent is hereby corrected as shown below:

Col. 1, Line 3, please insert the following:

--GOVERNMENT LICENSE RIGHTS
This invention was made with Government support under contract number FA9300-04-C-0008 awarded by the US Air Force. The Government has certain rights in the invention.--

Signed and Sealed this
Seventeenth Day of July, 2012

David J. Kappos

David J. Kappos
*Director of the United States Patent and Trademark Office*